US007296439B2

(12) United States Patent
Tanory, Jr.

(10) Patent No.: US 7,296,439 B2
(45) Date of Patent: Nov. 20, 2007

(54) JEWELRY SETTING, PARTICULARLY SUITED FOR DISPLAYING MULTIPLE FACES OR GEM STONES

(76) Inventor: Joe Richard Tanory, Jr., 267 W. Valley Ave., Suite 404, Birmingham, AL (US) 35209

( * ) Notice: Subject to any disclaimer, the term of this patent is extended or adjusted under 35 U.S.C. 154(b) by 0 days.

(21) Appl. No.: 11/370,039

(22) Filed: Mar. 8, 2006

(65) Prior Publication Data

US 2006/0150674 A1 Jul. 13, 2006

Related U.S. Application Data

(63) Continuation of application No. PCT/US2004/026729, filed on Sep. 9, 2004.

(60) Provisional application No. 60/501,095, filed on Sep. 9, 2003.

(51) Int. Cl.
*A44C 9/00* (2006.01)

(52) U.S. Cl. ..... 63/15; 63/40; 63/29.1; 63/26; 63/31

(58) Field of Classification Search ..... 63/15, 63/20, 26, 29.1, 31, 40
See application file for complete search history.

(56) References Cited

U.S. PATENT DOCUMENTS

| | | | | |
|---|---|---|---|---|
| 211,558 | A | 1/1879 | Edwards | |
| 292,963 | A * | 2/1884 | Thie | 63/1.15 |
| 368,984 | A * | 8/1887 | Vollmer | 63/18 |
| 922,212 | A | 5/1909 | Tropin | |
| 944,744 | A * | 12/1909 | Pine | 40/323 |
| 1,245,201 | A | 11/1917 | Depollier | |
| D64,845 | S | 6/1924 | Feingold et al. | |
| 1,536,365 | A * | 5/1925 | Wiseman | 63/1.12 |
| 1,553,198 | A * | 9/1925 | Stern | 63/31 |
| 1,565,651 | A | 12/1925 | Klass et al. | |
| 1,586,606 | A | 6/1926 | Cain | |
| 1,712,783 | A * | 5/1929 | Alpern | 63/15 |
| 1,920,875 | A | 8/1933 | Miskend | |
| 2,177,314 | A | 10/1939 | von Dachenhausen | |

(Continued)

FOREIGN PATENT DOCUMENTS

| | | |
|---|---|---|
| FR | 455177 | 7/1913 |
| GB | 19432 | 0/1904 |

OTHER PUBLICATIONS

International Search Report with written opinion dated Jul. 5, 2005, in PCT application No. PCT/US2004/26729, filed Sep. 9, 2004 (9 pages).

*Primary Examiner*—Jack W. Lavinder
(74) *Attorney, Agent, or Firm*—Shlesinger, Arkwright & Garvey LLP

(57) ABSTRACT

The invention relates to jewelry. More particularly, the invention relates to jewelry settings. Even more particularly, the invention relates to jewelry settings for displaying multiple faces or gems in a setting of a piece of jewelry, such as a ring, bracelet, pendant, brooch, necklace, religious icon, watch, earring, pin for clothing, hat pin, and the like. The setting may use a face rotatable about at least one axis and an engagement mechanism. The face may be a two-sided face or two separate faces, one facing outwardly away from the user and being visible, the other one of the faces being movable for facing toward the user and being hidden when the one face is visible.

11 Claims, 1 Drawing Sheet

U.S. PATENT DOCUMENTS

| | | | | | |
|---|---|---|---|---|---|
| D137,409 | S | | 3/1944 | Granat | |
| 2,357,697 | A | * | 9/1944 | Slater | 63/15 |
| D143,297 | S | | 12/1945 | Gantwarg | |
| 2,585,183 | A | * | 2/1952 | Stern | 63/15 |
| 2,598,281 | A | | 5/1952 | Meeker | |
| D188,805 | S | | 9/1960 | Hoffman et al. | |
| 3,307,375 | A | | 3/1967 | Estrin et al. | |
| 3,653,227 | A | | 4/1972 | Ricci | |
| 4,197,665 | A | * | 4/1980 | Siiter | 40/365 |
| 4,726,200 | A | * | 2/1988 | Carter | 63/15 |
| 4,854,133 | A | * | 8/1989 | Irwin | 63/15 |
| 4,932,396 | A | | 6/1990 | Garris | |
| D332,235 | S | | 1/1993 | Bonchek | |
| 5,353,608 | A | | 10/1994 | Berkowitz | |
| 5,428,974 | A | | 7/1995 | Shinohara | |
| D373,741 | S | | 9/1996 | Mehta | |
| D374,410 | S | | 10/1996 | Tanory, Jr. | |
| 5,588,310 | A | * | 12/1996 | Lai | 63/15 |
| 5,787,731 | A | * | 8/1998 | Ebara | 63/29.1 |

* cited by examiner

JEWELRY SETTING, PARTICULARLY SUITED FOR DISPLAYING MULTIPLE FACES OR GEM STONES

CROSS-REFERENCE TO RELATED APPLICATIONS

This application is a continuation of application no. PCT/US2004/026729, filed 9 Sep. 2004, which claims the convention priority of U.S. patent application Ser. No. 60/501,095, filed 9 Sep. 2003, and each of which is incorporated herein by reference.

FIELD OF THE INVENTION

The invention relates to jewelry. More particularly, the invention relates to jewelry settings. Even more particularly, the invention relates to jewelry settings for displaying multiple faces or gems in a setting of a piece of jewelry, such as a ring, bracelet, pendant, brooch, necklace, religious icon, watch, earring, pin for clothing, hat pin, and the like. The setting may include at least one or two faces rotatable about a single axis and an engagement mechanism.

BACKGROUND OF THE INVENTION

Jewelry has been worn for thousands of years.

Previous attempts have been made to provide jewelry settings suitable for displaying one or more faces or gems provided on a piece of jewelry.

Prior attempts have been unsatisfactory owing to complicated mechanisms which were difficult to use, involved many moving parts, and were otherwise unsatisfactory.

Known examples of jewelry include the following United States and foreign patents:

U.S. Pat. No. 211,558 to Edwards;
U.S. Pat. No. 922,212 to Tropin;
U.S. Pat. No. 1,245,201 to Depollier;
U.S. Pat. No. 1,565,651 to Klass et al.;
U.S. Pat. No. 1,712,783 to Alpern;
U.S. Pat. No. 1,920,875 to Miskend;
U.S. Pat. No. 2,177,314 to von Dachenhausen;
U.S. Pat. No. 2,598,281 to Meeker;
U.S. Pat. No. 2,585,183 to Stern;
U.S. Pat. No. 3,307,375 to Estrin et al.;
U.S. Pat. No. 3,653,227 to Ricci;
U.S. Pat. No. 4,932,396 to Garris;
U.S. Pat. No. 5,353,608 to Berkowitz;
U.S. Pat. No. 5,428,974 to Shinohara;
U.S. Pat. No. 4,726,200 to Carter;
U.S. Pat. No. 5,787,731 to Ebara;
U.S. Pat. No. Des. 64,845 to Feingold et al.;
U.S. Pat. No. Des. 1,586,606 to Cain;
U.S. Pat. No. Des. 137,409 to Granat;
U.S. Pat. No. Des. 143,297 to Gantwarg;
U.S. Pat. No. Des. 188,805 to Hoffman et al.;
U.S. Pat. No. Des. 332,235 to Bonchek;
U.S. Pat. No. Des. 373,741 to Mehta;
U.S. Pat. No. Des. 374,410 to Tanory, Jr.;

A known United Kingdom Patent is:

United Kingdom Patent No. 19,432 A.D. 1904, published provisional specification application dated Sep. 9, 1904, complete specification left Jun. 9, 1905, accepted Jul. 13, 1905 to Hamilton [A.D. 1904, Sept. 9. No. 19,432].

A known French patent is:

FR 455,177 to M. Gesseleff, FIGS. 1-10, July 1913.

OBJECTS AND SUMMARY OF THE INVENTION

It is an object of the invention to overcome the drawbacks of the prior art.

It is a further object of the invention to provide a jewelry setting or gem mount which is configured for displaying one or more, and, in particular, two or more faces on a piece of jewelry.

Another object of the invention is to provide a jewelry top face or setting which is easier to use, and more reliable than prior art devices.

In summary, the invention is directed to a jewelry setting including an outer setting, an inner setting substantially disposed within the outer setting. A gem or jewelry face may be provided in the inner setting, and a further gem or face may be provided on the substantially opposite side of the first gem face, in the case of a two (2) face setting. The setting is configured to be moveable between a first position in which the first gem faces outwardly, and a second position in which the second gem or face faces outwardly. In the second or moved position, the first gem or face may be disposed so that it faces inwardly towards the user and is not visible to the viewer of the piece of jewelry.

A securing or engagement device, such as a clasp may be provided on the setting for securing the faces in their respective display positions.

A pivot may be provided to assist in the movement of the inner setting from a first display position to a second display position.

The clasp may include a mouth and a mating pin or pivot arm. The pin maybe provided on the inner setting and the mouth may be provided on the outer setting, or vice versa.

The pin and mouth may be configured and sized for securely engaging each other for ensuring that the setting remains in the desired position.

The pin may be substantially or completely fixedly attached to one of the inner settings and outer settings, so as to reduce the number of moving parts.

The setting may be provided with a further mouth configured for receiving the pin in the second position of the setting in which the second face or gem is displayed. One or more pivot elements, such as pivot pins and mating indentations or through holes may be provided to assist in guiding the movement of the inner setting from its first position to its second position.

It will be understood that relative terms such as up, down, left, and right are for convenience only and are not intended to be limiting.

DETAILED DESCRIPTION OF THE INVENTION

Figure 1:
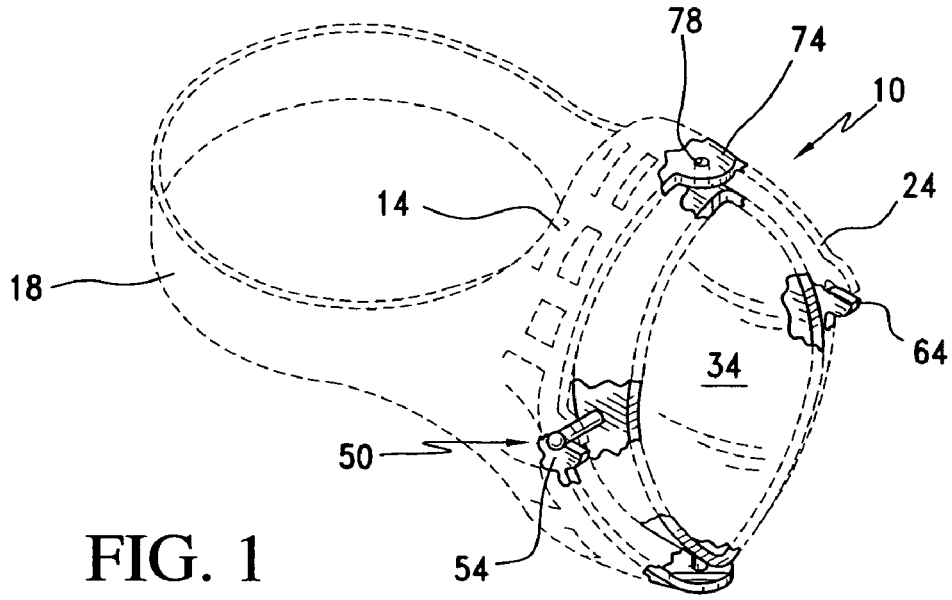
FIG. 1 is a perspective view of a jewelry setting according to the invention provided on a piece of jewelry, such as a ring.
Figure 2:
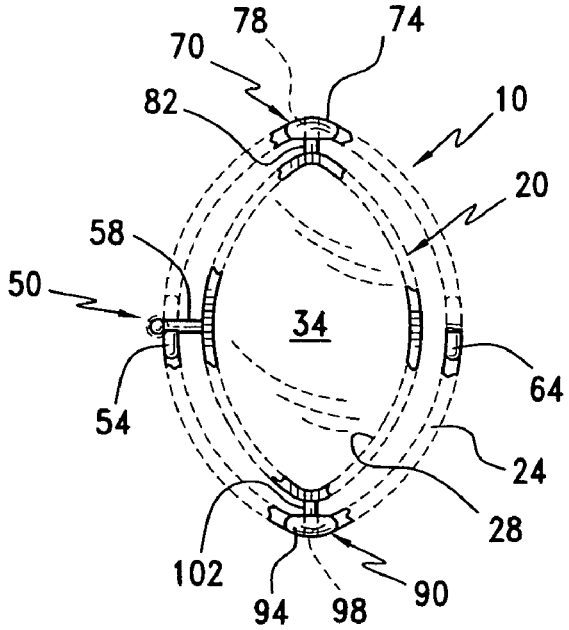
FIG. 2 is a top view of the embodiment of FIG. 1, showing the inner setting in its first display position with a first face or gem stone facing outwardly.
Figure 3:
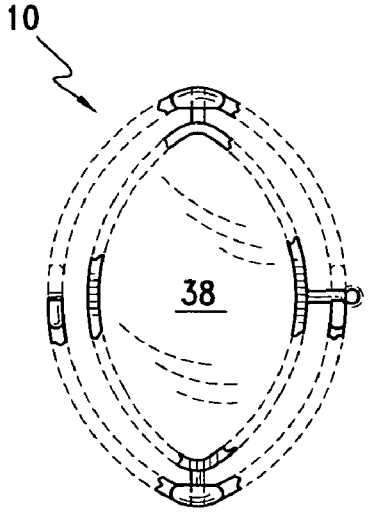
FIG. 3 is a plan view similar to FIG. 2, showing the inner setting in its second display position displaying a second face.

FIGS. 1-3 illustrate an embodiment of a piece of jewelry, such as a ring 10, according to the invention.

Ring 10 may include a ring body 14, a band 18, and a setting 20.

Band 18 is illustrated in broken or phantom line, as are other parts of the illustrative piece of jewelry according to the invention, here shown as ring 10. The phantom or broken lines are used to indicate that the band 18 is merely an example of the type of jewelry to which the setting 20 may be attached. Setting 20 may be provided on essentially any type of jewelry, such as a ring, bracelet, pendant, brooch, necklace, religious icon, watch, earring, pin for clothing, hat pin, and the like.

Setting 20 may include an outer setting 24 and an inner setting 28. A first face or first gem stone 34 may be provided in or on inner setting 28 and disposed so that it is visible in a first display position, such as shown in FIGS. 1 and 2.

As shown in FIG. 3, a second or opposite face or gem stone 38 may likewise be provided in inner setting 34. Second face 38 is configured for outward display when the inner setting 28 is in a second display position.

A clasp 50 may be provided for securing inner setting 28 relative to outer setting 24. Clasp 50 may include a female portion or mouth 54 and a male portion or pin 58. Mouth 54 may be substantially C-shaped. Pin 58 may be provided on inner setting 28, as shown, or on outer setting 24. In the case where pin 58 is provided on outer setting 24, a mating female portion could be provided on inner setting 24.

A further or second mouth 64 may be provided on outer setting 24.

Mouth 64 would typically be used when the jewelry setting 20 is in its second display position in which second gem face 38 faces outwardly.

One or more pivot elements may be provided. For example, a pivot 70 including a pivot face 74 and a recess or hole 78 may be provided in outer setting 24. A mating pin 82 may be provided on inner setting 28. The pivot pin is configured for mating with the hole. A restraining portion is provided, and the restraining portion includes recess or hole 78. The restraining portion is configured for restraining the inner setting within the outer setting.

The base may include a band configured for being worn on a user's finger, as shown. The outer setting 24 may be fixedly attached to the band, and the inner setting 28 and the first and second faces may then rotate about the first axis and move relative to the base 14, in use.

The first mouth 54 may be substantially C-shaped, as shown, and the C-shaped first mouth extends away from the base.

A first recess may be provided in the first mouth, the first recess being configured for detachably engaging the pin.

A further pivot 90 may be provided including a pivot face 94, a hole 98, and a mating pin 102. The pin 82 and the pin 102 may define a first axis.

The second mouth 64 may include a second recess configured for detachably engaging the pin 58, the second recess and the first recess defining a line, and the line extending substantially perpendicularly to the first axis.

As illustrated, none of the clasp or pivot elements need be spring-loaded, or moveable relative to the setting on which they are provided. This reduces the number of moving parts and adds to the robustness and integrity of the jewelry setting.

The jewelry and gem faces or gem stones may be made of any materials depending on the intended use and jewelry requirements. For example, one or both of faces 34, 38 may be synthetic gems, bas-reliefs, cloisonné, cameos, and the like.

It is likewise contemplated that one or more of the gem faces or gem stones may be detachably attached to the setting; e.g., with a spring-loaded device. In that manner, an even greater number of alternate faces could be provided, so that the user would have a larger variety of faces from which to choose for a single setting.

While this invention has been described as having a preferred design, it is understood that it is capable of further modifications, and uses and/or adaptations of the invention and following in general the principle of the invention and including such departures from the present disclosure as come within the known or customary practice in the art to which the invention pertains, and as may be applied to the central features hereinbefore set forth, and fall within the scope of the invention or limits of the invention described herein, and within the scope and limits of the claims set forth below.

The invention claimed is:

1. A piece of jewelry, comprising:

a) a body;

b) a setting provided in the body, the setting including an inner setting and an outer setting;

c) a pivot element provided between the inner setting and the outer setting, the pivot element defining a first axis, and the pivot element being configured for providing rotation of the inner setting relative to the outer setting about the first axis;

d) the pivot element including a restraining portion, the restraining portion being configured for restraining the inner setting within the outer setting e) a clasp provided between the inner setting and the outer setting, the clasp being located and configured for detachably attaching the inner setting to the outer setting;

f) the clasp including a first mouth and a pin;

g) the first mouth being substantially C-shaped, the C-shaped first mouth extending away from the body, a first recess being provided in the first mouth, the first recess being configured for detachably engaging the pin, and the pin being configured for detachably engaging with the C-shaped first mouth;

h) a grasping portion provided on the pin, the grasping portion being configured for being grasped by a user, so that a user may engage and disengage the pin with the mouth, in use;

i) a second mouth being provided, the second mouth being provided a distance from the first mouth, the second mouth being located relative to the first mouth so that, in use, when the pin is engaged with the first mouth and the user grasps the grasping portion of the pin and disengages the pin from the first mouth, the user may rotate the inner setting about the first axis sufficiently so that the pin moves out of engagement with the first mouth, moves to the second mouth, and then engages the second mouth, in use;

j) a first face provided in the inner setting, the first face being disposed so that the first face faces outwardly away from the user and is visible to the user, in use, when the pin is engaged with the first mouth; and k) a second face provided in the inner setting, the second face being disposed so that the second face faces outwardly away from the user and is visible to the user, in use, when the pin is engaged with the second mouth, and so that the first face is substantially hidden from the user, when the second face is visible to the user.

2. A piece of jewelry as in claim 1, wherein:

a) the pin is provided on the outer setting.

3. A piece of jewelry as in claim 2, wherein:

a) the second mouth is substantially C-shaped.

4. A piece of jewelry as in claim 1, wherein:

a) the second mouth is substantially C-shaped.

5. A piece of jewelry as in claim 1 , wherein:

a) the setting is substantially elliptical.

6. A piece of jewelry as in claim 1, wherein:

a) the restraining portion includes a hole.

7. A piece of jewelry as in claim 6, wherein:

a) the hole is provided in the outer setting.

8. A piece of jewelry as in claim 7, wherein:

a) the pivot element includes a pivot pin configured for mating with the hole.

9. A piece of jewelry as in claim 1 , wherein:

a) the body includes a band configured for being worn on a user's finger;

b) the outer setting is fixedly attached to the band; and c) the inner setting and the first and second faces rotate about the first axis and move relative to the body, in use.

10. A piece of jewelry as in claim 1, wherein:

a) the second mouth includes a second recess configured for detachably engaging the pin, the second recess and the first recess defining a line, and the line extending substantially perpendicularly to the first axis.

11. A piece of jewelry as in claim 1, wherein:

a) the setting is substantially elliptical.

* * * * *